US011421472B2

(12) United States Patent
Jin et al.

(10) Patent No.: US 11,421,472 B2
(45) Date of Patent: Aug. 23, 2022

(54) HOLLOW LOUVER TOP OPERATING SYSTEM

(71) Applicant: CHANGSHU HIGH-TECH ENERGY-SAVING DORWIN CO., LTD., Changshu (CN)

(72) Inventors: Chengzhe Jin, Changshu (CN); Renzhe Jin, Changshu (CN); Xiangjun An, Changshu (CN)

(73) Assignee: CHANGSHU HIGH-TECH ENERGY-SAVING DORWIN CO., LTD., Changshu (CN)

( * ) Notice: Subject to any disclaimer, the term of this patent is extended or adjusted under 35 U.S.C. 154(b) by 211 days.

(21) Appl. No.: 16/527,309

(22) Filed: Jul. 31, 2019

(65) Prior Publication Data

US 2020/0308904 A1 Oct. 1, 2020

(30) Foreign Application Priority Data

Mar. 26, 2019 (CN) ..... 201910234022.7

(51) Int. Cl.
*E06B 9/322* (2006.01)
*E06B 9/326* (2006.01)

(52) U.S. Cl.
CPC ..... *E06B 9/322* (2013.01); *E06B 9/326* (2013.01)

(58) Field of Classification Search
CPC .. E06B 9/322; E06B 2009/2646; E06B 9/326; E06B 9/264; E06B 9/2643; E06B 9/30; E06B 9/303; E06B 9/304; E06B 9/306; E06B 9/607; E06B 9/308
See application file for complete search history.

(56) References Cited

U.S. PATENT DOCUMENTS 4,513,804 A * 4/1985 Anderson ..... E06B 9/28 160/107
5,186,229 A * 2/1993 Hsu ..... A47H 5/00 160/176.1 R
5,699,845 A * 12/1997 Jelic ..... E06B 9/264 160/176.1 R
6,059,006 A * 5/2000 Rossini ..... E06B 9/264 49/82.1
7,082,982 B2 * 8/2006 Eveland ..... E06B 7/28 160/107
7,987,890 B2 * 8/2011 Wilson ..... E06B 9/303 160/176.1 R
9,410,364 B1 * 8/2016 Zheng ..... E06B 9/264
(Continued)

*Primary Examiner* — Johnnie A. Shablack
*Assistant Examiner* — Matthew R. Shepherd
(74) *Attorney, Agent, or Firm* — Brundidge & Stanger, P.C.

(57) ABSTRACT

Disclosed is a hollow louver top operating system comprising a rotating mechanism configured to open and close louver blades of a curtain; and a lifting mechanism configured to lift the curtain up and down, wherein the rotating mechanism comprises a rotating rope and a top rotating controller, and the rotating rope is connected between the top rotating controller and a first side of the curtain, wherein the lifting mechanism comprises a lifting rope and a top lifting controller, and the lifting rope is connected between the top lifting controller and a second side of the curtain, and wherein the top rotating controller and the top lifting controller are disposed in an upper frame portion of the window frame.

5 Claims, 3 Drawing Sheets

(56) References Cited

U.S. PATENT DOCUMENTS

| | | | | |
|---|---|---|---|---|
| 2006/0118250 | A1* | 6/2006 | Jin | E06B 9/264 160/107 |
| 2007/0017644 | A1* | 1/2007 | Berger | E06B 3/04 160/107 |
| 2008/0029226 | A1* | 2/2008 | Huang | E06B 9/264 160/107 |
| 2008/0083511 | A1* | 4/2008 | Hung | E06B 9/32 160/168.1 R |
| 2010/0132260 | A1* | 6/2010 | Lee | E06B 9/264 49/70 |
| 2011/0017408 | A1* | 1/2011 | Maksan | E06B 9/264 160/168.1 R |
| 2012/0061031 | A1* | 3/2012 | Zhang | E06B 9/264 160/107 |
| 2012/0240469 | A1* | 9/2012 | Zhang | E06B 9/322 49/89.1 |
| 2018/0355661 | A1* | 12/2018 | Hummel | E06B 9/264 |

* cited by examiner

HOLLOW LOUVER TOP OPERATING SYSTEM

TECHNICAL FIELD

The present disclosure relates to the technical field of hollow glass louver windows, particularly, to a hollow louver top operating system.

BACKGROUND ART

Built-in hollow glass louver is widely used in the world due to its good thermal insulation, sound insulation, anti-frost condensing, anti-dust polluting, and beautiful appearance. At present, built-in hollow glass louvers available on the market are generally equipped with a rotating controller and a lifting controller located at the same side or separately located at the left and right sides thereof to perform the rotating and lifting functions of the louvers curtain. The above two types of built-in hollow glass louvers with the controllers located at the same side or separately located at the left and right sides thereof can only be used in a casement window or a side sliding window. This is because, a vertical sliding window is composed of an upper sash and a lower sash, the upper sash is fixed and immovable, while the lower sash is an openable sash, the window is opened by pulling up the lower sash, and is closed by pulling down the lower sash. In light of this, if the built-in hollow glass louver was applicated to a vertical sliding window, the controllers located at the left and right sides thereof would be interfered by the controllers of the built-in hollow glass louver of another sash (upper fixed sash) and cannot be opened, and thus it turned out to be an unopenable window and cannot meet the requirements of indoor air ventilation. The reason for interference between the controllers of upper and lower sashes is that: a bump for containing the rotating and lifting controllers of the built-in hollow glass louver is at the same height as the openable sash, which prevents the sliding-up of the sash.

In addition, in the built-in hollow glass louver according to prior art, where the rotating controller and the lifting controller are located at the same side, rotating ropes of the rotating mechanism and flinging ropes of lifting mechanism controlled to operate in the same sliding channel may easily be entangled with each other, and this may cause failures.

SUMMARY OF THE INVENTION

In view of the above problems, an object of the present disclosure is to provide a hollow louver top operating system in which a rotating rope and a lifting rope may not be entangled.

In order to achieve the above object, the present disclosure provides a hollow louver top operating system comprising a rotating mechanism and a lifting mechanism, wherein the rotating mechanism is used for opening and closing louver blades of a curtain, and the lifting mechanism is used for lifting the curtain up and down, wherein the rotating mechanism comprises a rotating rope and a top rotating controller, and the rotating rope is connected between the top rotating controller and one side of the curtain, wherein the lifting mechanism comprises a lifting rope and a top lifting controller, and the lifting rope is connected between the top lifting controller and the other side of the curtain, and wherein the curtain is located inside a window frame, and the top rotating controller and the top lifting controller are disposed in the window frame at the upper portion of the curtain.

Preferably, the top rotating controller comprises an outer rotating controller outside an inner glass of a hollow glass and an inner rotating controller inside the inner glass, wherein the inner rotating controller and the outer rotating controller with the inner glass interposed therebetween magnetically attract each other, and the rotating rope comprises a first rotating rope and a second rotating rope, wherein the rotating mechanism further comprises a rotating rope direction-turning member, a rotating rope angle-turning member, two first rotating shafts, a second rotating shaft, a metal wire and a ladder rope, wherein the two first rotating shafts are respectively located at the left and right sides of at upper portion of the curtain, and the metal wire passes through the second rotating shaft and one first rotating shaft at one side and the other first rotating shaft at the other side, wherein the first rotating shafts at both sides are connected to the ladder rope, the one first rotating shaft at the one side is connected to the second rotating rope, and the second rotating shaft is connected to the first rotating rope, wherein the second rotating rope and the first rotating rope respectively connected to the one first rotating shaft at the one side and the second rotating shaft are respectively inserted into the rotating rope angle-turning member and are respectively turned and connected to the inner rotating controller via a pulley, and wherein when the outer rotating controller moves left or right, the first rotating rope and the second rotating rope are driven by the inner rotating controller to control the left or right rotation of the second rotating shaft, which drives the first rotating shaft to rotate, and when the first rotating shaft rotates, the ladder rope is driven to open or close the louver blades.

Preferably, the top lifting controller comprises an outer lifting controller outside the inner glass and an inner lifting controller inside the inner glass, wherein the inner lifting controller and the outer lifting controller with the inner glass interposed therebetween magnetically attract each other, the lifting mechanism further comprises a fixing member fixed to the window frame, a lifting rope angle-turning member, a bearing assembly and two lifting shafts, and the two lifting shafts are located at the left and right sides of at upper portion of the curtain, wherein the lifting rope is fixed to each louver blade of the curtain, is turned and connected to the lifting rope angle-turning member through the lifting shaft, is turned and connected to the inner lifting controller through the bearing assembly, and then is turned and connected to the fixing member via the inner lifting controller so as to be fixed, and wherein as the outer lifting controller and the inner lifting controller move left or right, the lifting rope is driven by the lifting shaft and the bearing assembly to lift the curtain up or down.

Preferably, the lifting mechanism comprises two bearing assemblies, one bearing assembly for direction-turning of the lifting rope between the inner lifting controller and the lifting rope angle-turning member, and the other bearing assembly for direction-turning of the lifting rope between the lifting rope angle-turning member and the lifting shaft.

Preferably, the fixing member is a copper block, and the copper block is provided with a wire insertion hole and two screw holes, and wherein a plastic pipe is inserted and then the lifting rope is inserted into the wire insertion hole, and after the lifting rope is inserted, it is tightened and fixed with screws, and then the lifting rope is knotted.

Further, preferably, the system further includes a plurality of brackets for fixing the first rotating shaft, the second rotating shaft and the lifting shaft, and the first rotating shaft and the lifting shaft may be fixed to one of the plurality of brackets.

In addition, preferably, the window frame includes an upper frame, a left frame, a right frame, and a lower frame, and the upper frame, the left frame, the right frame, and the lower frame combined with each other at corners, to form a frame structure.

Further, preferably, an upper cover is further included, the upper cover is fastened to the upper frame to form a window frame cavity, and a hollow cavity is formed by placing and adhering a prepared window frame tightly onto an outer glass and then placing and adhering an inner glass tightly onto the window frame, and wherein the curtain is disposed in the hollow cavity, and the inner rotating controller and the inner lifting controller are disposed in the window frame cavity formed by the upper cover.

Further, preferably, a plurality of fixing grooves for fixing the rotating mechanism and the lifting mechanism are provided inside the upper frame.

In the hollow louver top operating system according to the present disclosure, the rotating rope in the rotating mechanism is connected to the top rotating controller at one side, and the lifting rope of the lifting mechanism is connected to the top lifting controller at the other side, the rotating rope and the lifting rope do not interfere with each other and thus may not be entangled during operation.

In addition, the rotating controller and the lifting controller of the hollow louver top operating system are disposed at the upper portion of the curtain, and may not interfere with the controllers of the fixed sash on the vertical sliding window, thus can be applied to the vertical sliding window without interference while opening the bottom sash. The hollow louver top operating system according to the present application can ensure privacy and security, improve production efficiency, save materials, and easily operated.

DETAILED DESCRIPTION OF THE EMBODIMENTS

In the following description, for the purpose of illustration, many specific details are described so as to provide a comprehensive understanding of one or more embodiments of the present disclosure. However, it will be obvious to those skilled in the art that the embodiments may be also implemented without these specific details. In other examples, well known structures and devices are shown in block diagram form for the convenience of the description of the one or more embodiments.

Embodiments of the present disclosure will be described in detail below with reference to the accompanying drawings.

Figure 1:
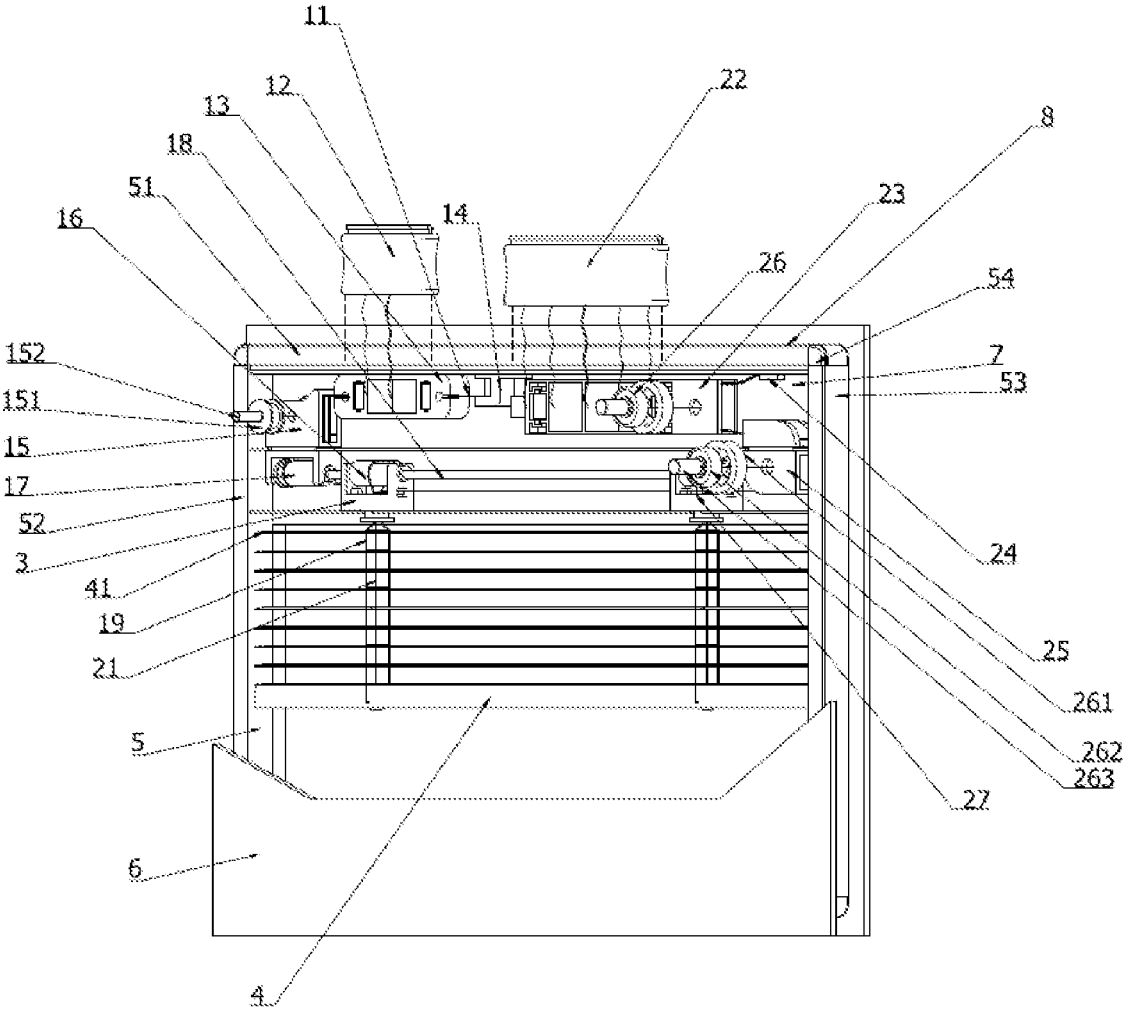
FIG. 1 is a schematic view of the hollow louver top operating system according to the present disclosure.

FIG. 1 is a schematic view of the hollow louver top operating system of the present disclosure. As illustrated in FIG. 1, the hollow louver top operating system includes a rotating mechanism 1 and a lifting mechanism 2. The rotating mechanism 1 is used for opening and closing louver blades 41 of a curtain 4, and the lifting mechanism 2 is used for lifting up and down the curtain 4. The rotating mechanism 1 comprises a rotating rope 11 and a top rotating controller, and the rotating rope 11 is connected between the top rotating controller and one side of the curtain 4. The lifting mechanism 2 comprises a lifting rope 21 and a top lifting controller, the lifting rope 21 is connected between the top lifting controller and the other side of the curtain 4. The curtain 4 is located inside a window frame 5, and the top rotating controller and the top lifting controller are disposed in the window frame at the upper portion of the curtain.

Figure 2:
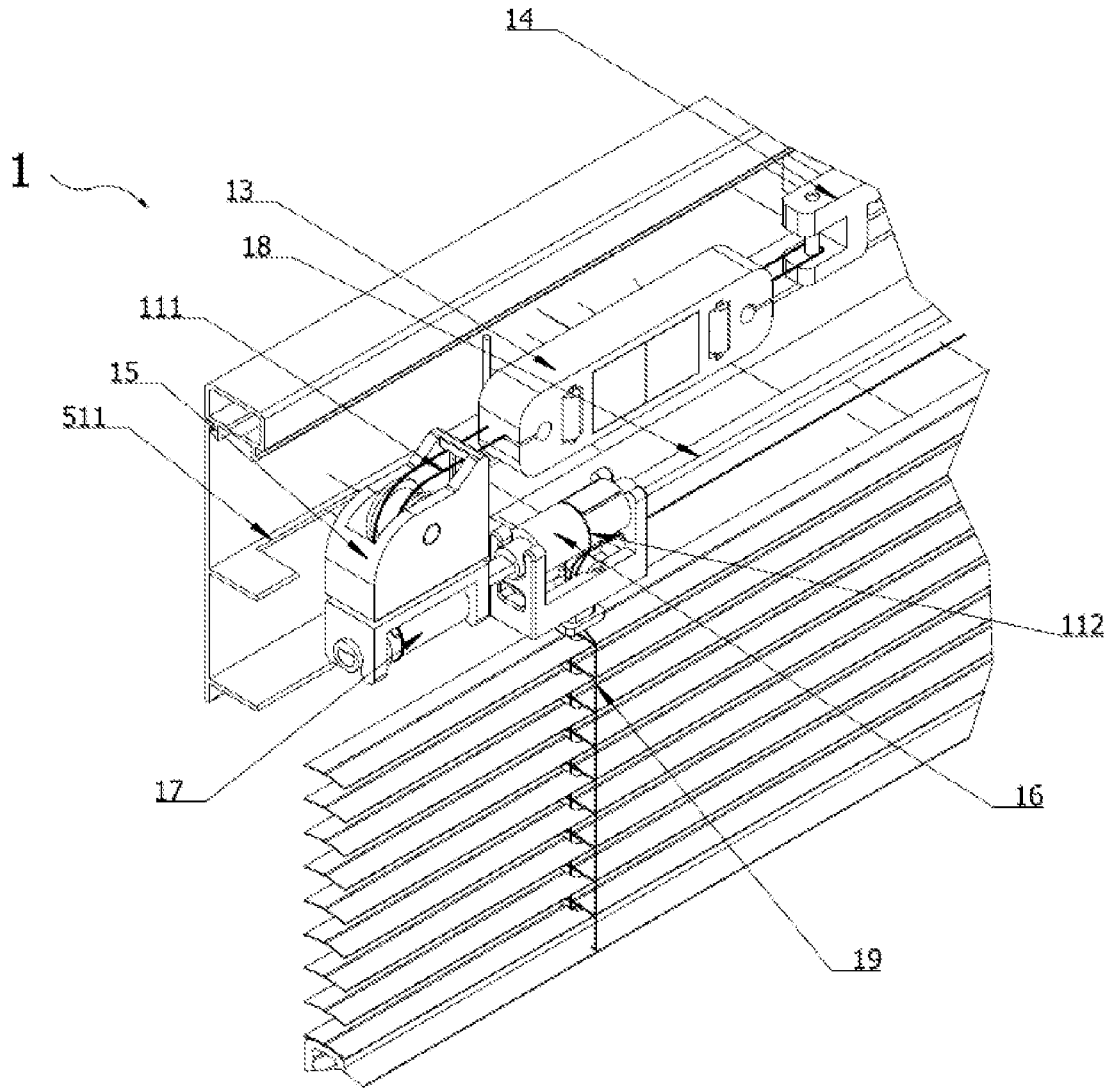
FIG. 2 is a schematic view of the rotating mechanism according to the present disclosure.

As illustrated in FIGS. 1 and 2, the top rotating controller comprises an outer rotating controller 12 outside an inner glass 6 of a hollow glass and an inner rotating controller 13 inside the inner glass 6. The inner rotating controller 13 and the outer rotating controller 12 with the inner glass 6 interposed therebetween magnetically attract each other. The rotating rope 11 comprises a first rotating rope 111 and a second rotating rope 112. The rotating mechanism further comprises a rotating rope direction-turning member 14 and a rotating rope angle-turning member 15, two first rotating shafts 16, a second rotating shaft 17, a metal wire 18 and a ladder rope 19. The two first rotating shafts 16 are respectively located at the left and right sides of the upper portion of the curtain, the metal wire 18 passes through the second rotating shaft 17, and one first rotating shaft 16 at one side and the other first rotating shaft 16 at the other side. The one first rotating shafts 16 at both sides are connected to the ladder rope, the first rotating shaft 16 at the one side is connected to the second rotating rope 112, and the second rotating shaft 17 is connected to the first rotating rope 111. The second rotating rope 112 and the first rotating rope 111 respectively connected to the first rotating shaft 16 at the one side and the second rotating shaft 17 are respectively inserted into the rotating rope angle-turning member 15, which includes a pulley 151 and a pulley bolt 152, and are respectively turned and connected to the inner rotating controller 13 and the rotating rope direction-turning member 14 via a pulley 151. When the outer rotating controller 12 moves left or right, the first rotating rope 111 and the second rotating rope 112 are driven by the inner rotating controller 13 to control the left or right rotation of the second rotating shaft 17, which drives the first rotating shaft 16 to rotate, and when the first rotating shaft 16 rotates, the ladder rope 19 is driven to open or close of the louver blades 41.

Preferably, the metal wire 18 is fixedly connected to the second rotating shaft 17, but is not fixed to the first rotating shaft 16. For example, the metal wire 18 is inserted into the first rotating shaft 16 and the second rotating shaft 17, and the metal wire 18 and the second rotating shaft 17 are combined together by glue. In addition, preferably, the metal wire 18 is an iron wire having a shape corresponding to the insertion holes of the first rotating shaft 16 and the second rotating shaft 17. For example, the insertion holes of the first rotating shaft and the second rotating shaft have semi-circular shapes and the metal wire 18 is an iron wire having cross-sectional shape of a semi-circular.

Figure 3:
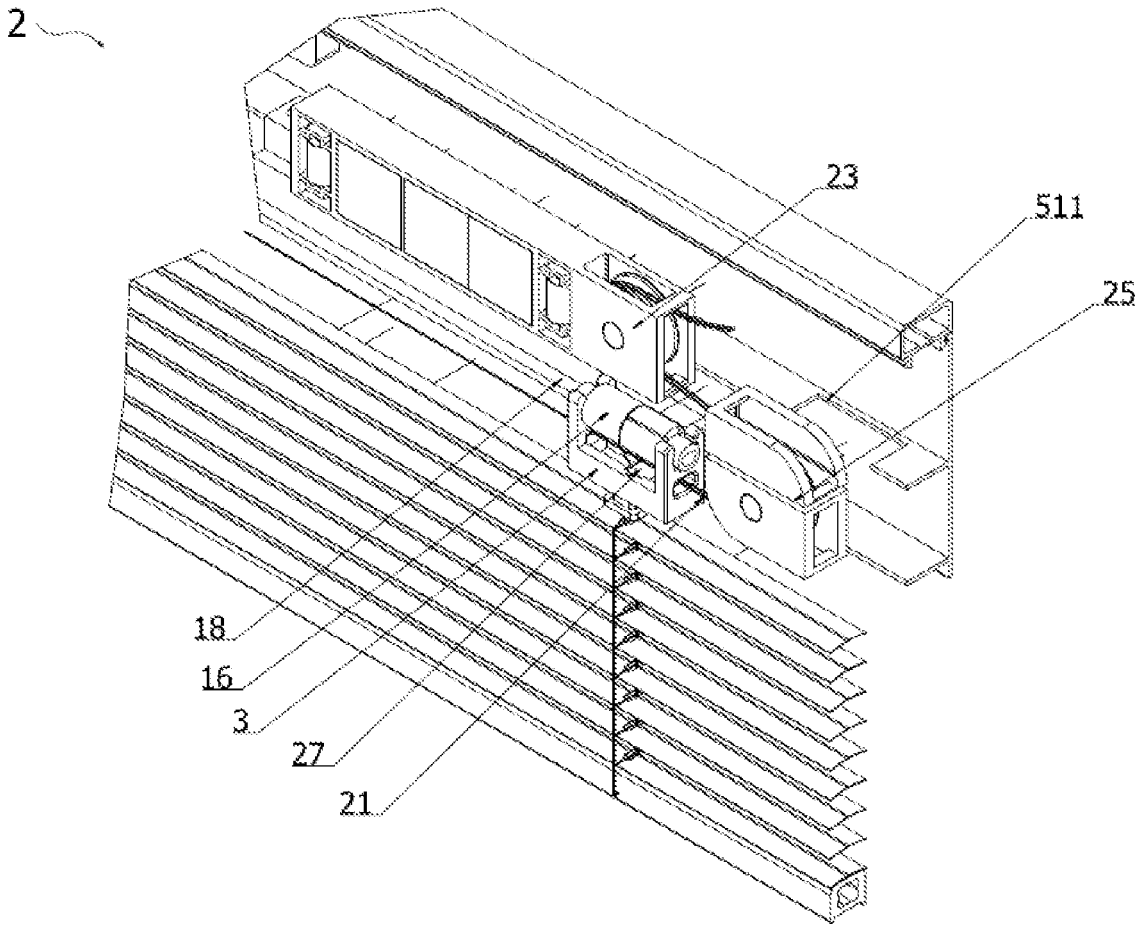
FIG. 3 is a schematic view of the lifting mechanism according to the present disclosure.

As illustrated in FIGS. 1 and 3, the top lifting controller comprises an outer lifting controller 22 outside the inner glass 6 and an inner lifting controller 23 inside the inner glass 6. The inner lifting controller 23 and the outer lifting controller 22 with the inner glass 6 interposed therebetween magnetically attract each other. The lifting mechanism further comprises a fixing member 24 fixed to the window frame, a lifting rope angle-turning member 25, a bearing assembly 26 and two lifting shafts 27. The two lifting shafts 27 are located at the left and right sides of the upper portion of the curtain. The lifting rope 21 fixed to each louver blade of the curtain is turned and connected to the lifting rope angle-turning member 25 via the lifting shaft 27, is turned and connected to the inner lifting controller 23 via the bearing assembly 26, and then is turned and connected to the fixing member 24 via the inner lifting controller 23 so as to be fixed. As the outer lifting controller 22 and the inner lifting controller 23 move left or right, the lifting rope 21 is driven by the lifting shaft 27 and the bearing assembly 26 to lift the curtain up or down.

Preferably, the fixing member 24 is a copper block provided with a wire insertion hole and two screw holes, and a plastic pipe is inserted and then the lifting rope 21 into the wire insertion hole. After the lifting rope 21 is inserted into the wire insertion hole, it is fastened and fixed with screws, and then the lifting rope 21 is knotted.

Preferably, the lifting mechanism 2 comprises two bearing assemblies 26, one bearing assembly 26 for direction-turning of the lifting rope 21 between the inner lifting controller 23 and the lifting rope angle-turning member 25, and the other bearing assembly 26 for direction-turning of the lifting rope 21 between the lifting rope angle-turning member 25 and the lifting shaft 27, wherein each of the bearing assembly 26 includes a bearing sleeve 261, a bearing 262 and a bearing bolt 263.

As illustrated in FIG. 1, the hollow louver top operating system further includes a plurality of brackets 3 for respectively fixing the first rotating shaft 16, the second rotating shaft 17 and the lifting shaft 27.

Preferably, the first rotating shaft 16 and the lifting shaft 27 are fixed to one of the plurality of brackets 3, as illustrated in FIGS. 1-3, in the brackets 3 at the left and right sides of the upper portion of the curtain, two first rotating shaft 16 are respectively fixed at the upper side and two lifting shaft 27 are respectively fixed at the lower side thereof.

As illustrated in FIG. 1, the window frame 5 includes an upper frame 51, a left frame 52, a right frame 53, and a lower frame, and the upper frame 51, the left frame 52, the right frame 53, and the lower frame are combined with each other at corners 54, to form a frame structure.

Preferably, a plurality of fixing grooves 511 for fixing the rotating mechanism and the lifting mechanism are provided inside the upper frame 51.

Preferably, the hollow louver top operating system further comprises an upper cover 7, and the upper cover 7 is fastened to the upper frame 51 to form a window frame cavity. A hollow cavity is formed by placing and adhering a prepared window frame tightly onto an outer glass 8 and then placing and adhering an inner glass 6 tightly onto the window frame. The curtain 4 is disposed in the hollow cavity, the inner rotating controller 13 and the inner lifting controller 23 are disposed in the window frame cavity formed by the upper cover.

Although the exemplary embodiments of the present disclosure are descripted in detail, it should be understood that various changes and modifications may be made thereto without deviating from the scope of the appended claims. In addition, although elements of the present disclosure may be described as singular element, it may also refer to plural elements, unless explicitly limited to a single element.

What is claimed is:

1. A hollow louver top operating system, comprising:

a rotating mechanism configured to open and close louver blades of a curtain; and a lifting mechanism configured to lift the curtain up and down, wherein the rotating mechanism comprises a rotating rope, a top rotating controller, a rotating rope direction-turning member, and a rotating rope angle-turning member, and the rotating rope is connected between the top rotating controller and a first side of the curtain, wherein the lifting mechanism comprises a lifting rope, a top lifting controller, a fixing member fixed in a window frame, a lifting rope angle-turning member, and a first bearing assembly, and the lifting rope is connected between the top lifting controller and a second side of the curtain, and wherein the window frame includes an upper frame portion, a left frame portion, a right frame portion, and a lower frame portion, and the upper frame portion, the left frame portion, the right frame portion, and the lower frame portion combined with each other at corners of the window frame, to form a frame structure, wherein a plurality of fixing grooves for fixing the rotating mechanism and the lifting mechanism are provided inside the upper frame portion, wherein the top rotating controller comprises an outer rotating controller outside a first glass layer of a hollow glass and an inner rotating controller inside the hollow glass, wherein the inner rotating controller and the outer rotating controller magnetically attract each other with the first glass layer therebetween, wherein the top lifting controller comprises an outer lifting controller outside the first glass layer and an inner lifting controller inside the hollow glass, wherein the inner lifting controller and the outer lifting controller magnetically attract each other with the first glass layer interposed therebetween, wherein the inner rotating controller, the rotating rope direction-turning member, and the rotating rope angle-turning member are disposed in the upper frame portion of the window frame, and wherein the inner lifting controller, the fixing member, the lifting rope angle-turning member, and the first bearing assembly are disposed in the upper frame portion of the window frame.

2. The hollow louver top operating system according to claim 1, wherein the rotating rope comprises a first rotating rope and a second rotating rope, wherein the rotating mechanism further comprises two first rotating shafts, a second rotating shaft, a metal wire and a ladder rope, wherein the two first rotating shafts are respectively located at left and right sides of the upper frame portion of the window frame, and the metal wire passes through the second rotating shaft, the first rotating shaft at the left side and the first rotating shaft at the right side, wherein the two first rotating shafts are connected to the ladder rope, the first rotating shaft at the left side is connected to the second rotating rope, and the second rotating shaft is connected to the first rotating rope, wherein the second rotating rope and the first rotating rope respectively connected to the first rotating shaft at the left side and the second rotating shaft are respectively inserted into the rotating rope angle-turning member and are respectively turned and connected to the inner rotating controller via a pulley, and wherein when the outer rotating controller moves left or right, the first rotating rope and the second rotating rope are driven by the inner rotating controller to control left or right rotation of the second rotating shaft, which drives the two first rotating shafts to rotate, and when the two first rotating shafts rotate, the ladder rope is configured to be driven to open or close the louver blades.

3. The hollow louver top operating system according to claim 2, wherein the lifting mechanism further comprises two lifting shafts, and the two lifting shafts are located at left and right sides of the upper frame portion of the window frame, wherein the lifting rope is configured to be fixed to each louver blade of the curtain, is turned and connected to the lifting rope angle-turning member via the two lifting shafts, is turned and connected to the inner lifting controller via the first bearing assembly, and then is turned and connected to the fixing member via the inner lifting controller so as to be fixed, and wherein as the outer lifting controller and the inner lifting controller move left or right, the lifting rope is driven by the two lifting shafts and the first bearing assembly to lift the curtain up or down.

4. The hollow louver top operating system according to claim 3, further comprising a plurality of brackets for respectively fixing the two first rotating shafts, the second rotating shaft and the two lifting shafts.

5. The hollow louver top operating system according to claim 3, wherein the lifting mechanism comprises a second bearing assembly and a third bearing assembly, the second bearing assembly for direction-turning of the lifting rope between the inner lifting controller and the lifting rope angle-turning member, and the third bearing assembly for direction-turning of the lifting rope between the lifting rope angle-turning member and the lifting shaft at right side.

* * * * *